US006226312B1

(12) United States Patent
Poloni et al.

(10) Patent No.: US 6,226,312 B1
(45) Date of Patent: May 1, 2001

(54) DEVICE TO COOL AND PROTECT A CATHODE IN AN ELECTRIC ARC FURNACE

(75) Inventors: Alfredo Poloni, Fogliano di Redipuglia; Milorad Pavlicevic; Stefano Morsut, both of Udine, all of (IT)

(73) Assignee: Danieli & C. Officine Meccaniche, Buttrio (IT)

( * ) Notice: Subject to any disclaimer, the term of this patent is extended or adjusted under 35 U.S.C. 154(b) by 0 days.

(21) Appl. No.: 09/588,017

(22) Filed: Jun. 6, 2000

(30) Foreign Application Priority Data

Jun. 11, 1999 (IT) ..... UD99A0110

(51) Int. Cl.[7] ..... H05B 7/10
(52) U.S. Cl. ..... 373/94; 373/37; 373/72
(58) Field of Search ..... 373/72, 52, 94, 373/93, 73, 36, 37

(56) References Cited

U.S. PATENT DOCUMENTS 3,777,040 12/1973 Gell et al. .
4,197,900 4/1980 Bloshemko et al. .
5,125,002 * 6/1992 Steitz et al. ..... 373/37
5,648,981 * 7/1997 Miner, Jr. et al. ..... 373/74

FOREIGN PATENT DOCUMENTS 0838531 4/1998 (EP) .
2697398 4/1994 (FR) .

* cited by examiner

*Primary Examiner*—Tu Ba Hoang
(74) *Attorney, Agent, or Firm*—Stevens, Davis, Miller & Mosher, LLP

(57) ABSTRACT

Device to cool and protect a cathode in an electric arc furnace, wherein the cathode comprises at least a consumable column, a structure, hollow on the inside and containing a cooling liquid, arranged around the column and provided with a first lower chamber in which a liquid is suitable to evaporate and a second upper chamber in which the condensation of steam is suitable to occur, at least two vertical conduits being provided to connect the two chambers.

12 Claims, 3 Drawing Sheets

DEVICE TO COOL AND PROTECT A CATHODE IN AN ELECTRIC ARC FURNACE

FIELD OF THE INVENTION

The invention concerns a device to cool and protect a cathode in an AC or DC electric arc furnace (EAF), used in steel plants for melting ferrous materials, preferentially scrap, or other metals.

To be more exact, the invention refers to a device suitable to cool and protect the consumable part, for example made of graphite, of each electrode of the furnace.

BACKGROUND OF THE INVENTION

The state of the art includes electric arc furnaces (EAF) in which each electrode or cathode made of graphite is vertically supported by a clamp located at the end of a horizontal arm which has the other end connected to a bearing column.

The graphite column which constitutes the electrode is obtained by connecting several segments together, joined by means of intermediate elements called nipples, made of the same material.

The maximum thermo-mechanical tensions and the dynamic forces due to the vibration of the arm occur both in correspondence with the intermediate joining elements and in correspondence with the clamp of the electrode-bearing arm.

These stresses can cause the electrode to break: the greater the free length of inflection (height) of the column and the cantilever of the arm, and the higher the temperature of the electrode, the greater the probability of the electrode breaking.

In the electric furnace, in fact, during the step when the metal is melting, the graphite column normally reaches very high temperatures due to the effect of the electric arc, the passage of the electric currents employed (Joule effect) and the heat exchange with the inner environment of the furnace, and therefore it tends to be progressively consumed. It is thus necessary to replace it with new segments of graphite.

The state of the art includes cooling systems and devices which act prevalently, if not exclusively, in correspondence with the metallic portion of the electrode, to remove a part of the heat which migrates through conduction from the graphite column towards the metallic part. In this way these systems attempt to lower the temperature of the graphite column by lowering the temperature of the metallic part of the electrode.

Such cooling systems and devices however are not completely satisfactory and never achieve their set purpose; hence, in practice, they do not perform an efficient cooling of the lower part, made of graphite, of the cathode.

The present Applicant has devised, tested and embodied this invention to overcome the shortcomings of the state of the art and to obtain further advantages.

SUMMARY OF THE INVENTION

The device to cool and protect a cathode in an electric arc furnace according to the invention is set forth and characterized in the main claim, while the dependent claims describe other innovative characteristics of the invention.

One purpose of the invention is to achieve a device which will make possible to cool the lower, consumable part of the cathode and at the same time will protect it from possible mechanical yielding and/or breakages in its structure, prevalently caused by the high temperatures.

Another purpose of the invention is to achieve a cooling device which will exploit the evaporation of water and the high heat exchange involved in the process of changing state (gas-liquid)

The invention therefore proposes to solve the problem of the electrode breaking by introducing into the structures of furnaces of a conventional type a cooled element of mechanical reinforcement.

This element has a jacket conformation and is cooled by means of a closed evaporation circuit, suitable to move solidly with the electrode and electrically insulated therefrom.

The jacket is divided inside by a vertical baffle into at least two volumes or channels communicating at their upper and lower ends.

The baffle allows to separate the evaporation portion from the condensation portion, which is thermally insulated from the surrounding environment.

A condenser, consisting of a heat exchanger, provides to condense the steam which thus rises, due to the anti-gravity effect, into the upper part of the element.

On the contrary the condensed water descends, due to gravity, into the lower collection part, where it begins to evaporate, thus closing the cycle.

To be more exact, the device according to the invention comprises a metallic structure or jacket, arranged outside the consumable graphite part of the cathode and provided with a group of ascending and descending conduits which connect the lower chamber where the cooling water collects and the upper chamber where the steam condenses and is transformed into water. The steam rises from the lower chamber to the upper chamber along one of the conduits, while the water descends from the upper chamber to the lower chamber along another conduit.

In one form of embodiment, the steam rises along the conduit nearest the outer surface of the cathode, while the water descends along the outermost conduit which is hence farthest from the outer surface of the cathode.

The outer part, that is to say, the part not facing towards the cathode, may be covered by any type of insulating material in order to preserve it from the high temperatures in the furnace.

This solution not only cools the cathode but also reduces the chances of its breaking. Only a part of the consumable graphite portion protrudes from the jacket and therefore it is much more resistant to the radial tensions to which the electrode is normally subjected.

According to another variant, the water tank in the jacket or radiator, that is to say, the lower chamber, may be above half or even reach two thirds of the whole metallic structure, excluding the zone of the condenser. In this way the surface affected by the high heat exchange is increased and it is possible to cool the electrode more easily, so that its temperature diminishes by 300–400° C.

In another embodiment, the jacket is provided with three channels, of which at least one, for example the one nearest the cathode, is for the steam and another, for example the central one, is for the water.

According to another embodiment, with three vertical channels, the central one is used for the water to descend, while the two lateral channels, both subject to high thermal gradients due to the presence of fumes and the cathode, are used for the steam to ascend.

In all these embodiments the steam thus formed rises inside the ascending channel or channels until it reaches the upper chamber of the circuit, or condensation zone, where it comes into contact with the relatively cool walls of the condenser, condenses and gives up heat.

The drops of condensation which are deposited on the walls cause a film of water to form which, due to the effects of gravity, flows along the downward channel until it reaches the lower chamber or evaporation zone, cooling the portion of the cathode associated therewith.

As it flows into the evaporation zone, the condensation then mixes with the water lying there, removing heat from the cathode. Due to the effect of the latent energy which accompanies the change of state, a large quantity of heat is transferred from the evaporation zone to the condensation zone.

The overall heat exchange in the device according to the invention is a function of the values of the coefficients of heat exchange in the evaporation and condensation steps.

The device according to the invention allows to obtain the following advantages:

- to reduce the consumption of the graphite electrodes;
- to reinforce the mechanical system of the column-arm-electrode;
- to cool the electrode with the benefit of mechanical resistance;
- to reduce the free length of inflection of the column of the electrode.

This leads to improvements in the mechanical resistance and the duration of the electrode.

BRIEF DESCRIPTION OF THE DRAWINGS

These and other characteristics of the invention will be evident from the following description of some preferred forms of embodiment, given as a non-restrictive example with reference to the attached drawings wherein.

DETAILED DESCRIPTION OF PREFERRED EMBODIMENTS

Figure 1:
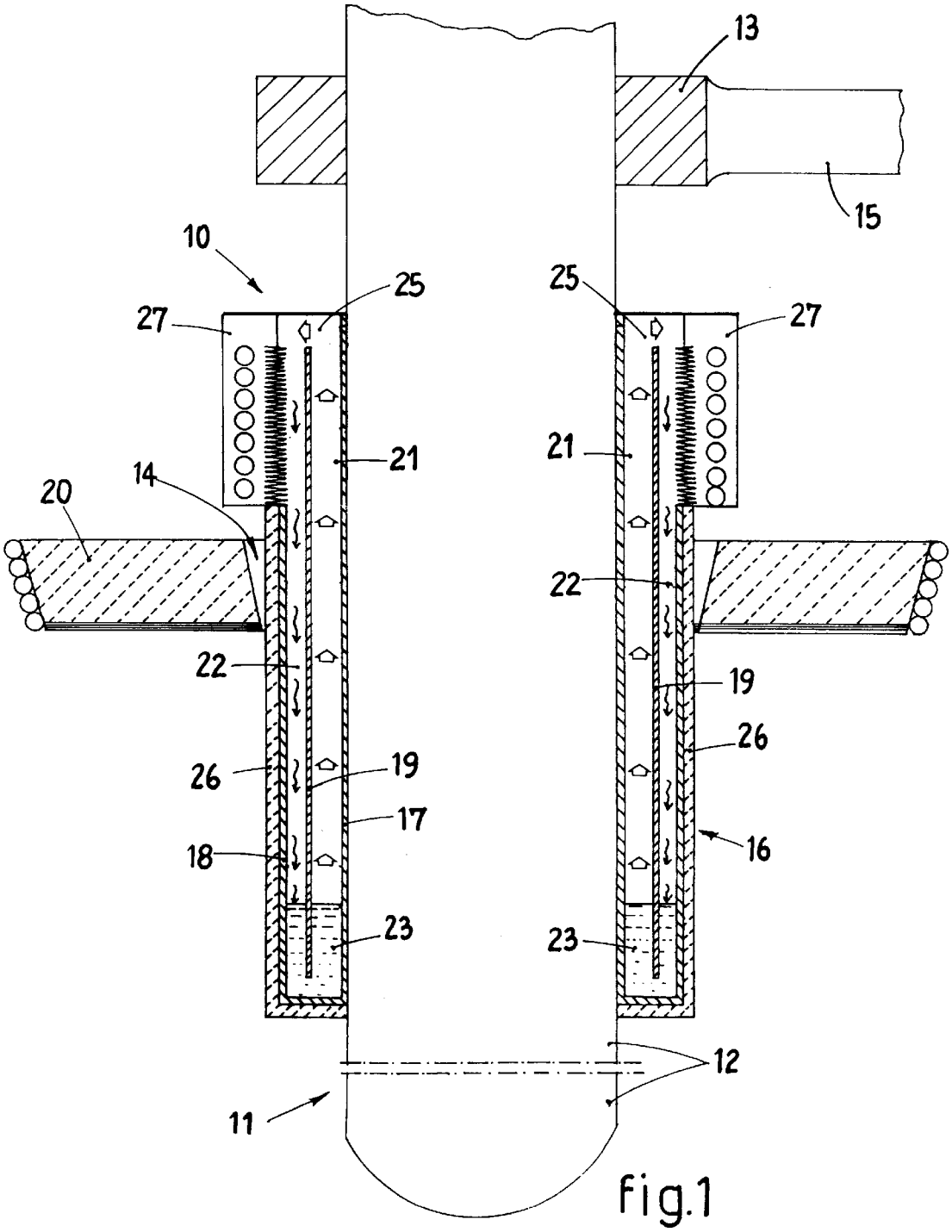
FIG. 1 is a longitudinal, schematic section of a device to cool a cathode of an electric arc furnace according to the invention.

With reference to FIG. 1, a cooling device 10 according to the invention is shown applied to an electrode or cathode 11 in an electric arc furnace of a conventional type, not shown in the drawings.

The cathode 11 comprises a vertical column 12, made of graphite, supported by a clamp 13 located at the end of a horizontal arm 15, which is in turn supported in a conventional manner by a bearing column not shown in the drawings.

The device 10 comprises an annular metallic structure or jacket 16, for example made of steel, arranged around the graphite column 12 and partly housed inside a hole 14 in the upper roof 20 of the electric furnace.

The structure 16 comprises an inner wall 17, an outer wall 18 and at least a dividing wall 19, which together are suitable to define a first vertical channel 21 arranged between the inner wall 17 and the dividing wall 19 and a second vertical channel 22 arranged between the dividing wall 19 and the outer wall 18.

In the lower part of the structure 16 there is a first chamber 23, while in the upper part of the structure 16 there is a second chamber 25, communicating with the first chamber 23 through the vertical channels 21 and 22.

The structure 16 may be lined externally with a layer 26 of refractory material.

Inside the structure 16 a cooling liquid is inserted, for example water.

In correspondence with the upper chamber 25 there is a condenser 27 of a conventional type, suitable to make the steam condense which forms in the lower chamber 23 or evaporation zone, and which rises through one of the vertical channels, for example channel 21. The drops of condensation formed in the upper chamber 25, or condensation zone, descend towards the lower chamber 23 through the other vertical channel, for example channel 22.

The device as described heretofore is suitable to cool and at the same time protect the column 12 which is most subject to heating and reaching very high temperatures. It allows to constrain the column 12 so as to reduce the possibility of breakage.

Figure 2:
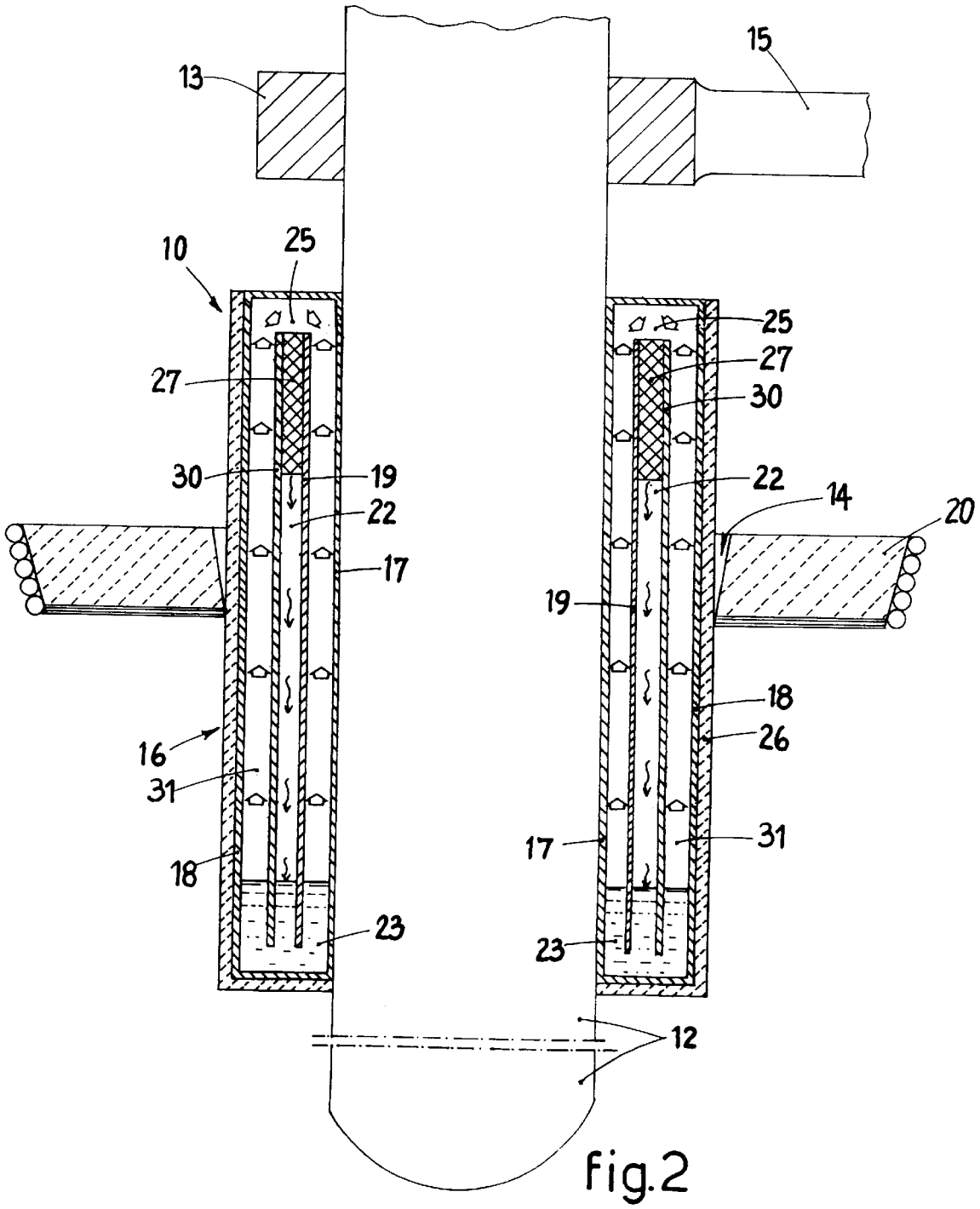
FIG. 2 is a longitudinal, schematic section of a first variant of the device shown in FIG. 1.

According to another form of embodiment, as shown in FIG. 2, the structure 16 is provided with a second dividing wall 30, parallel to the wall 18, which defines a third outer vertical channel 31.

In this case, the drops of water which condense in the upper chamber 25 are suitable to descend towards the lower chamber 23 through the central channel 22, while the steam formed in the lower chamber 23 rises through the lateral channels 21 and 31.

Figure 3:
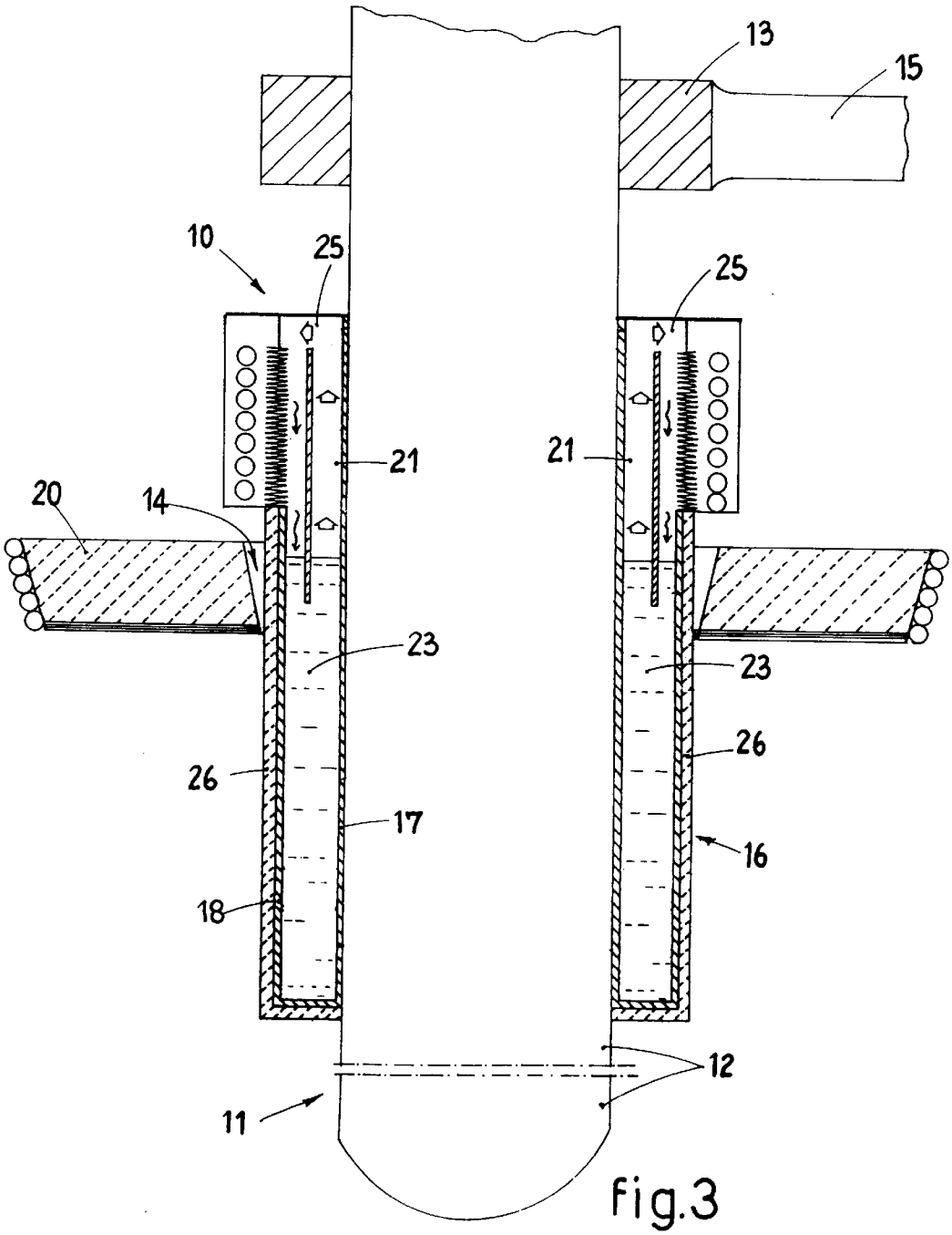
FIG. 3 is a longitudinal, schematic section of a second variant of the device shown in FIG. 1.

According to a third form of embodiment, as shown in FIG. 3, the lower chamber 23 has a height of up to about two thirds of the total height of the structure 16.

It is obvious that modifications and additions can be made to the cooling device described heretofore, but these shall remain within the field and scope of the invention.

What is claimed is:

1. A device to cool and protect a cathode in an electric arc furnace, wherein the cathode comprises at least a consumable column, comprising:

a structure, hollow on the inside and containing a cooling liquid arranged around said column and provided with a first lower chamber in which the liquid is able to evaporate and a second upper chamber in which the condensation of the evaporated liquid is able to occur and at least two vertical conduits provided to connect said two chambers.

2. The device as in claim 1, wherein said structure is able to realize a mechanical reinforcement of said consumable column.

3. The device as in claim 1, wherein a condenser is provided in correspondence with said upper chamber to facilitate the condensation of said steam.

4. The device as in claim 3, wherein said condenser is arranged outside said structure.

5. The device as in claim 1, wherein said structure comprises an inner wall, an outer wall and at least a dividing wall, which together define said at least two vertical conduits.

6. The device as in claim 1, wherein said structure comprises two dividing walls able to define a central vertical conduit and two peripheral vertical conduits.

7. The device as in claim 3, wherein said condenser is arranged in the upper part of said central vertical conduit.

8. The device as in claim 1, wherein the height of said lower chamber is equal to at least two thirds of the total height of said structure.

9. The device as in claim 1, wherein said structure is partly housed inside a hole in the upper roof of said electric arc furnace.

10. The device as in claim 3, wherein said condenser is arranged outside said upper roof.

11. The device as in claim 6, wherein said condenser is arranged in the upper part of said central vertical conduit.

12. The device as in claim 9, wherein said condenser is arranged outside said upper roof.

* * * * *

UNITED STATES PATENT AND TRADEMARK OFFICE

CERTIFICATE OF CORRECTION

PATENT NO. : 6,226,312 B1 
DATED : May 1, 2001
INVENTOR(S) : Alfredo Poloni, Milorad Pavlicevic and Stefano Morsut It is certified that error appears in the above-identified patent and that said Letters Patent is hereby corrected as shown below:

Title page,
The name of the Assignee is not only "Danieli & C. Officine Meccaniche" but
-- Danieli & C. Officine Meccaniche S.p.A. --

Signed and Sealed this

Twenty-third Day of April, 2002

*Attest:*

*Attesting Officer*

JAMES E. ROGAN
*Director of the United States Patent and Trademark Office*